US008522815B2

(12) United States Patent
Honda et al.

(10) Patent No.: US 8,522,815 B2
(45) Date of Patent: Sep. 3, 2013

(54) GAS SHUTOFF DEVICE

(75) Inventors: Tsuyoshi Honda, Kyoto (JP); Takuhisa Ootani, Nara (JP); Kouji Murase, Nara (JP)

(73) Assignee: Panasonic Corporation, Osaka (JP)

( * ) Notice: Subject to any disclaimer, the term of this patent is extended or adjusted under 35 U.S.C. 154(b) by 204 days.

(21) Appl. No.: 13/140,375

(22) PCT Filed: Dec. 16, 2009

(86) PCT No.: PCT/JP2009/006937
§ 371 (c)(1),
(2), (4) Date: Jun. 16, 2011

(87) PCT Pub. No.: WO2010/070902
PCT Pub. Date: Jun. 24, 2010

(65) Prior Publication Data

US 2011/0247711 A1 Oct. 13, 2011

(30) Foreign Application Priority Data

Dec. 19, 2008 (JP) ..... 2008-323689

(51) Int. Cl.
*F16K 17/00* (2006.01)

(52) U.S. Cl.
USPC ... 137/459; 137/467; 137/487.5; 137/624.12; 700/282

(58) Field of Classification Search
USPC ..... 137/456, 459, 460, 486, 487.5, 624.11, 137/624.12, 467; 700/282
See application file for complete search history.

(56) References Cited

U.S. PATENT DOCUMENTS 4,690,170 A * 9/1987 Tsai et al. ..... 137/624.11
4,797,666 A * 1/1989 Baxter et al. ..... 340/606
4,839,790 A * 6/1989 Fujimoto et al. ..... 700/282

(Continued)

FOREIGN PATENT DOCUMENTS

JP 10-103546 A 4/1998
JP 2001-193928 A 7/2001

(Continued)

OTHER PUBLICATIONS

International Search Report for International Application No. PCT/JP2009/006937, dated Feb. 16, 2010, 1 page.

*Primary Examiner* — Eric Keasel
(74) *Attorney, Agent, or Firm* — Brinks Hofer Gilson & Lione

(57) ABSTRACT

With a gas shutoff device in the related art, a non-uniform gas layer can be produced by mixing of a gas of a different type from the gas currently in use during a shift in the amount of heat or installation or replacement, and an unexpected flow rate may be detected due to a disruption in the propagation of ultrasonic waves, thereby causing an erroneous determination of a flow rate abnormality or a sensor abnormality. With the gas shutoff device according to the invention, a valve-closing timer section 14 starts to time based on a valve-closing signal which is output by the flow rate abnormality or the sensor abnormality, and outputs a valve-opening signal to a valve driving section 12 if a release input is accepted from outside within a setting time period. Thus, even when the non-uniform gas layer is produced by mixing the gas of a different type from the gas currently in use during the shift in the amount of heat or installation or replacement, an unexpected flow rate is detected due to the disruption in the propagation of ultrasonic waves, thereby causing the erroneous determination of the flow rate abnormality or the sensor abnormality, and the valve is closed, the erroneous determination is resolved and the gas is available again within a given time period.

9 Claims, 2 Drawing Sheets

(56) References Cited

U.S. PATENT DOCUMENTS

| | | | | | |
|---|---|---|---|---|---|
| 4,866,633 | A * | 9/1989 | Nakane et al. | 700/282 |
| 5,038,820 | A * | 8/1991 | Ames et al. | 137/460 |
| 5,126,934 | A * | 6/1992 | MacFadyen | 137/487.5 |
| 5,251,653 | A * | 10/1993 | Tucker et al. | 137/460 |
| 5,971,011 | A * | 10/1999 | Price | 137/460 |
| 6,209,576 | B1 * | 4/2001 | Davis | 137/487.5 |
| 6,708,722 | B1 * | 3/2004 | Goodenough | 137/487.5 |
| 8,166,999 | B2 * | 5/2012 | Ueki et al. | 137/487.5 |

FOREIGN PATENT DOCUMENTS

| | | | |
|---|---|---|---|
| JP | 3624642 | B2 | 3/2005 |
| JP | 2007-147430 | A | 6/2007 |

* cited by examiner

GAS SHUTOFF DEVICE

This application is a 371 application of PCT/JP2009/006937 having an international filing date of Dec. 16, 2009, which claims priority to JP2008-323689 filed on Dec. 19, 2008, the entire contents of which are incorporated herein by reference.

TECHNICAL FIELD

The present invention relates to a gas shutoff device for causing a gas to be available again even if a valve-closing occurs due to an erroneous determination of a flow rate abnormality or a sensor abnormality which occurs when a gas of a different type from the gas currently in use is mixed, for example, by a shift in the amount of heat of a city gas or an LP gas, etc, or by installation or replacement.

BACKGROUND ART

A gas shutoff device in the related art is constituted, as shown in FIG. 2, by a flow rate detection section 1 which outputs a flow rate signal 'a' in response to a gas flow rate passing through a gas passage; a flow rate calculation section 2 which calculates a flow rate 'b' upon receiving the flow rate signal 'a'; an abnormal flow rate determination section 3 which compares the flow rate 'b' with a previously-retained determination value upon receiving the flow rate, and outputs a valve-closing signal 'c' if abnormality exists in the comparison; a valve driving section 4 which outputs a valve driving signal 'd' upon receiving the valve-closing signal 'c' from the abnormal flow rate determination section 3, a valve-opening signal from a recovery input section 8, or the valve-closing signal 'c' from a sensor abnormality determination section 6; a valve 5 which opens or closes the gas passage upon receiving the valve driving signal 'd'; the sensor abnormality determination section 6 which performs an abnormality determination whether the flow rate signal 'a' from the flow rate detection section 1 is in accord with a predetermined abnormal condition, and outputs the valve-closing signal 'c' only if the abnormality exists; an accumulation section 7 which accumulates and retains the flow rate 'b' from the flow rate calculation section 2; and the recovery input section 8 which outputs the valve-opening signal 'e' upon accepting a recovery input from outside (refer to Patent Literature 1, for example).

CITATION LIST

Patent Literature

Patent Literature 1; JP-3624642B2

SUMMARY OF INVENTION

Technical Problem

However, since the gas shutoff device in the related art as mentioned above performs the abnormal flow rate determination, the sensor abnormality determination and the accumulation on the basis of the flow rate signal 'a' which has been detected by the flow rate detection section 1, a non-uniform gas layer can be produced by mixing of a gas of a different type from the gas currently in use during a shift in the amount of heat or installation or replacement of the gas shutoff device, and an unexpected flow rate from the measuring condition may be detected due to the propagation of the ultrasonic waves differently from that when the gas is distributed uniformly. In this case, there may be a case where the flow rate abnormality or the sensor abnormality is determined despite that the flow rate and the sensor is in a normal state, and thus the valve is closed. Since the valve driving section 4 is configured not to receive the valve-opening signal 'e' from the recovery input section 8 during the flow rate abnormality or the sensor abnormality to secure the safety of the gas shutoff device, there is a problem that the gas is unavailable even if the device is in normal.

Solution to Problem

In a gas shutoff device according to the invention, in order to solve the problems as mentioned above, a valve-closing timer section 14 starts to time in response to that a valve driving section 12 receives a valve-closing signal C from an abnormal flow rate determination section 11 and a sensor abnormality determination section 15, and outputs a valve-closing signal to a valve 13. The valve-closing timer section 14 outputs a valve-opening signal E to the valve driving section 12 if it receives a release input from outside within a predetermined setting time. By this configuration, if the gas is unavailable because the valve is closed due to the abnormality determination based on an unexpected flow rate from a measuring condition, the valve can be opened when the release signal is accepted within a given time period after the valve-closing. Accordingly, even when a non-uniform gas layer is produced by mixing of a gas of a different type from the gas currently in use during a shift in the amount of heat or installation or replacement of the gas shutoff device, and an unexpected flow rate from the measuring condition may be detected due to the propagation of the ultrasonic waves differently from that when the gas is distributed uniformly, thereby closing the valve due to the fact that the flow rate abnormality or the sensor abnormality is erroneously determined, the gas can be available again by allowing the erroneous determination to be released within the given time period.

Advantageous Effects of Invention

The gas shutoff device according to the invention can causes the gas to be available again by allowing the erroneous determination to be released within the given time period, even when a non-uniform gas layer is produced by mixing of a gas of a different type from the gas currently in use during a shift in the amount of heat or installation or replacement of the gas shutoff device, and an unexpected flow rate from the measuring condition may be detected due to the propagation of the ultrasonic waves differently from that when the gas is distributed uniformly, thereby closing the valve due to the fact that the flow rate abnormality or the sensor abnormality is erroneously determined. Accordingly, even if the flow rate abnormality or the sensor abnormality is erroneously determined during the construction such as the shift in the amount of heat or installation or replacement of the gas shutoff device, the construction can be continued by the release input by a construction worker. If the flow rate abnormality or the sensor abnormality occurs truly, the release input is not accepted because the construction worker does not exist. Further, even if the release input is received after the given time period from the abnormality determination, the flow rate abnormality and the sensor abnormality are not released. Thus, the safety of the gas shutoff device is secured.

DESCRIPTION OF EMBODIMENTS

Figure 1:
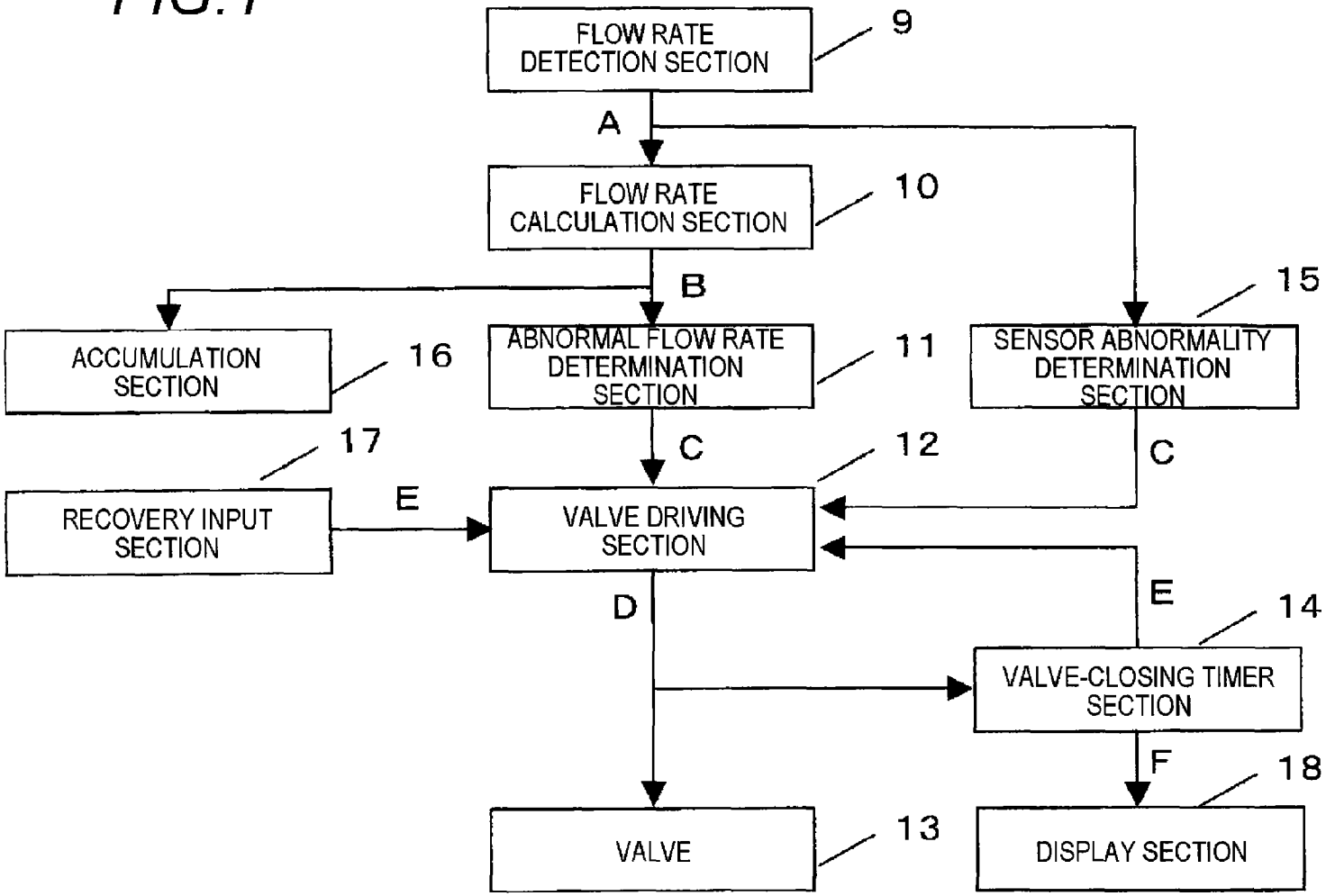
FIG. 1 is a control block diagram of a gas shutoff device according to a first embodiment of the invention.
Figure 2:
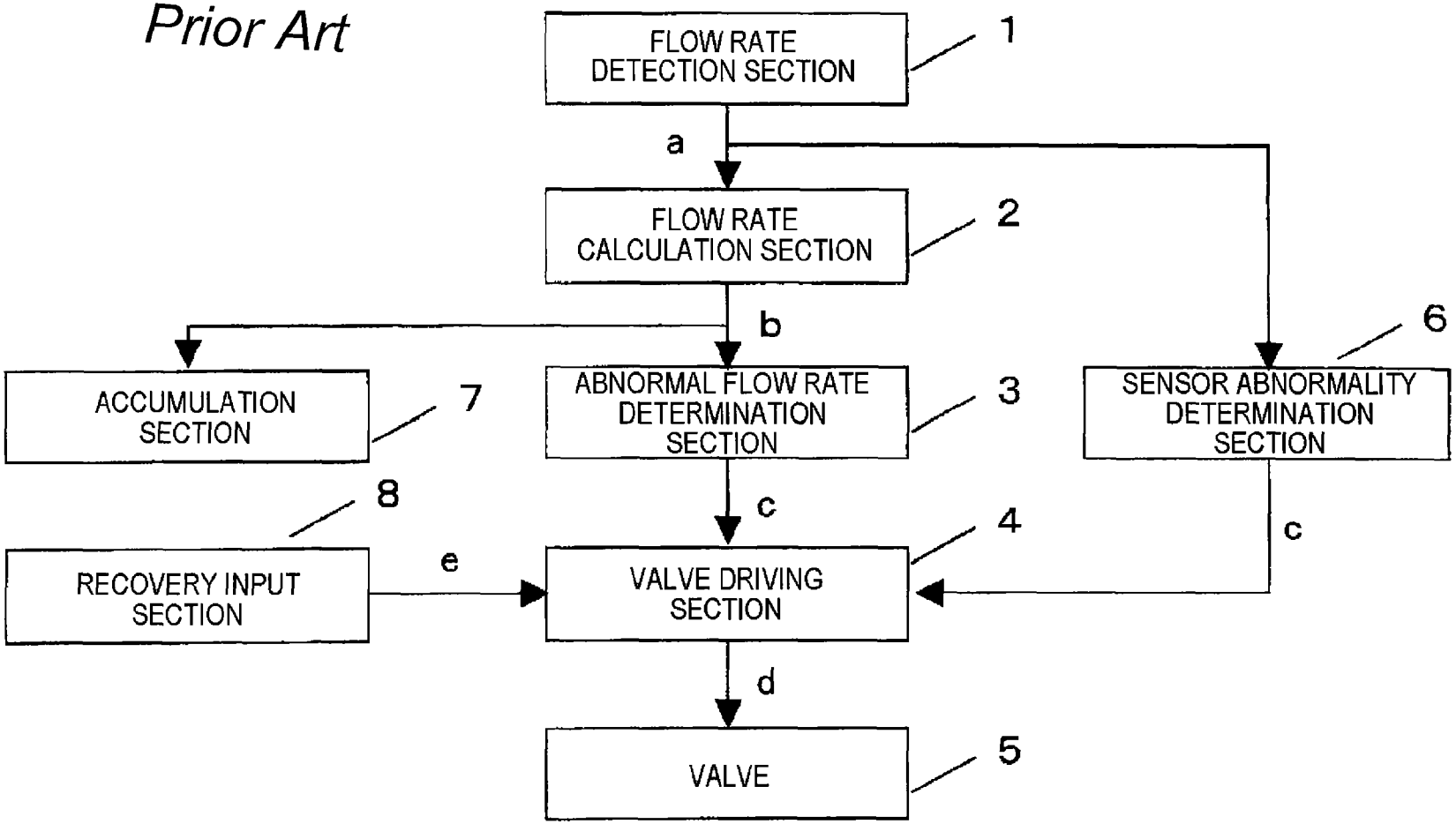
FIG.2 Prior Art
FIG. 2 is a control block diagram of a gas shutoff device in the background art.

A first aspect of the invention includes: a flow rate detection section which outputs a flow rate signal in response to a gas flow rate passing through a gas passage; a flow rate calculation section which calculates a flow rate upon receiving the flow rate signal; an abnormal flow rate determination section which compares the flow rate with a previously-retained determination value upon receiving the flow rate, and outputs a valve-closing signal if abnormality exists in the comparison; a sensor abnormality determination section which outputs a valve-closing signal if the flow rate signal is in accord with a predetermined abnormal condition; a valve driving section which outputs a valve-closing drive signal as a valve driving signal upon receiving the valve-closing signal, and outputs a valve-opening drive signal as the valve driving signal upon receiving a valve-opening signal; a valve which opens or closes the gas passage upon receiving the valve driving signal from the valve driving section; and a valve-closing timer section which starts to time upon receiving the valve-closing drive signal from the valve driving section, and outputs the valve-opening signal upon accepting an external release input within a predetermined setting time from the start to time. According to the configuration, in a case where the abnormality flow rate determination section and the sensor abnormality determination section have determined the unexpected flow rate signal from the measuring condition as an abnormality and causes the valve to be closed, the valve is opened when the release input is accepted within a given time period after the valve-closing. By this configuration, even when a non-uniform gas layer is produced by mixing of a gas of a different type from the gas currently in use during a shift in the amount of heat or installation or replacement of the gas shutoff device, and an unexpected flow rate from the measuring condition may be detected due to the propagation of the ultrasonic waves differently from that when the gas is distributed uniformly, thereby closing the valve due to the fact that the flow rate abnormality or the sensor abnormality is erroneously determined, the gas can be available again by allowing the erroneous determination to be released within the given time period. Accordingly, even if the flow rate abnormality or the sensor abnormality is erroneously determined during the construction such as the shift in the amount of heat or installation or replacement of the gas shutoff device, the construction can be continued by the release input by a construction worker. If the flow rate abnormality or the sensor abnormality occurs truly, the release input is not accepted because the construction worker does not exist. Further, even if the release input is received after the given time period from the abnormality determination, the flow rate abnormality and the sensor abnormality are not released. Thus, the safety of the gas shutoff device is secured.

A second aspect of the invention causes the valve-closing timer section to be able to change, from outside, the previously-set time for accepting the release input. Thus, it can be changed to an appropriate time period compatible with a construction time for the shift in the amount of heat or the installation or replacement of the gas shutoff device after the gas shutoff device is produced. Accordingly, if there is occurred a case where the erroneous determination of the flow rate abnormality or the sensor abnormality cannot be released under construction such as the shift in the amount of heat or the installation or replacement of the gas shutoff device, this type of problem can be decreased by elongating the setting value. Further, it becomes unnecessary to set the time period for accepting the release input to be longer more than necessary. Thus, the abnormality determination when the flow rate abnormality or the sensor abnormality is truly occurred can be determined early, thereby improving the safety of the gas shutoff device.

A third aspect of the invention causes the valve-closing timer section to accept the release input only within the previously-set time for accepting the release input and when the number of times for accepting the release input is less than a predetermined setting number of times. If the flow rate abnormality or the sensor abnormality is truly occurred, the abnormality determination is repeated many times even if the abnormality determination is released. Thus, it becomes possible to determine the abnormality early because the release input is accepted only when the number of times for accepting the release input is less than the predetermined setting number of times, thereby improving the safety of the gas shutoff device.

A fourth aspect of the invention causes the valve-closing timer section to be able to change, from outside, the previously-set number of times for accepting the release input. Thus, it can be changed to an appropriate number of times compatible with a construction for the shift in the amount of heat or the installation or replacement of the gas shutoff device after the gas shutoff device is produced. Accordingly, if there is occurred a case where the erroneous determination of the flow rate abnormality or the sensor abnormality cannot be released under construction such as the shift in the amount of heat or the installation or replacement of the gas shutoff device, the occurrence of this type of problem can be decreased by increasing the setting value. Further, it becomes unnecessary to set the number of times for accepting the release input to be increased more than necessary. Thus, the abnormality determination when the flow rate abnormality or the sensor abnormality is truly occurred can be determined early, thereby improving the safety of the gas shutoff device.

A fifth aspect of the invention causes the valve-closing timer section to output a display signal indicating that the release input is accepted and the valve-opening signal is output. Upon viewing this indication, the construction workers, etc. can find that the flow rate abnormality or the sensor abnormality occurs, that the release input is accepted and the valve is opened, or how many times the release input is accepted. Accordingly, it becomes possible for the construction workers, etc. to find that the valve-closing occurs due to the erroneous determination, due to the truly flow rate abnormality or the sensor abnormality, or due to the fact other than the flow rate abnormality and the sensor abnormality.

A sixth aspect of the invention causes the valve-closing timer section to externally output information indicating that the release input is accepted and the valve-opening signal is output. Upon finding the information, one can find that the flow rate abnormality or the sensor abnormality occurs, that the release input is accepted and the valve is opened, or how many times the release input is accepted. Accordingly, even if the person does not join the construction, it becomes possible to find that the valve-closing occurs due to the erroneous determination, due to the truly flow rate abnormality or the sensor abnormality, or due to the fact other than the flow rate abnormality and the sensor abnormality.

Hereinafter, an embodiment of the invention is described with reference to drawings. The present invention is not limited in any way by this embodiment.

First Embodiment

FIG. 1 is a control block diagram of a gas shutoff device according to a first embodiment of the invention. In FIG. 1, reference numeral 9 indicates a flow rate detection section which outputs a flow rate signal in response to a gas flow rate passing through a gas passage. Reference numeral 10 indicates a flow rate calculation section which calculates a flow rate on the basis of the flow rate signal. Reference numeral 11 indicates an abnormal flow rate determination section which outputs a valve-closing signal when detected an abnormal flow rate. Reference numeral 12 indicates a valve driving section which outputs a valve-opening drive signal for opening a valve 13 or a valve-closing drive signal for closing the valve 13 as a valve driving signal on the basis of an input of a valve-opening signal or a valve-closing signal. Reference numeral 13 indicates the valve which opens or closes the gas passage upon receiving the valve driving signal from the valve driving section 12. Reference numeral 14 indicates a valve-closing timer section which starts to time on the basis of the valve-closing drive signal from the valve driving section. Reference numeral 15 indicates a sensor abnormality determination section which outputs the valve-closing signal when an abnormality occurs in the flow rate signal. Reference numeral 16 indicates an accumulation section which accumulates and retains the flow rate. Reference numeral 17 indicates a recovery input section which outputs the valve-opening signal upon accepting a recovery input from outside. Reference numeral 18 indicates a display section which is set to provide construction workers with information on a flow rate abnormality, a sensor abnormality, or the like.

Next, an operation of the gas shutoff device is described. The flow rate detection section 9 outputs a flow rate signal A in response to a gas flow rate passing through a gas passage. The flow rate calculation section 10 calculates a flow rate B upon receiving the flow rate signal A. The abnormal flow rate determination section 11 compares the flow rate B with a previously-retained determination value upon receiving the flow rate B, and outputs a valve-closing signal C if abnormality exists in the comparison. The valve driving section 12 outputs a valve-opening drive signal or a valve-closing drive signal as a valve driving signal D upon receiving the valve-closing signal C from the abnormal flow rate determination section 11, a valve-opening signal E from the valve-closing timer section 14 and the recovery input section 17, or a valve-closing signal C from the sensor abnormality determination section 15. It is configured so that the valve-opening signal E from the recovery input section 17 is not accepted during the flow rate abnormality and the sensor abnormality in order to secure the safety of the gas shutoff device. The valve 13 opens or closes the gas passage upon receiving the valve driving signal D from the valve driving section 12. The valve-closing timer section starts to time upon receiving only the valve-closing drive signal of the valve driving signal D. When accepted a release input from outside (for example, an operation which only the construction workers knows, or a recovery signal through external communication) within a predetermined setting time, the valve-closing timer section 14 outputs the valve-opening signal E. The recovery input section 17 outputs the valve-opening signal E upon accepting the recovery input from outside. The sensor abnormality determination section 15 performs an abnormality determination whether the flow rate signal A from the flow rate detection section 9 is in accord with a predetermined abnormal condition, and outputs the valve-closing signal C if the abnormality exists. In a case where the abnormality flow rate determination section 11 and the sensor abnormality determination section 15 have determined the unexpected flow rate signal A from the measuring condition as an abnormality and causes the valve to be closed, the valve is opened when the release input is accepted within a given time period after the valve-closing. By this configuration, even when a non-uniform gas layer is produced by mixing of a gas of a different type from the gas currently in use during a shift in the amount of heat or installation or replacement of the gas shutoff device, and an unexpected flow rate from the measuring condition may be detected due to the propagation of the ultrasonic waves differently from that when the gas is distributed uniformly, thereby closing the valve due to the fact that the flow rate abnormality or the sensor abnormality is erroneously determined, the gas can be available again by allowing the erroneous determination to be released within the given time period. Accordingly, even if the flow rate abnormality or the sensor abnormality is erroneously determined during the construction such as the shift in the amount of heat or installation or replacement of the gas shutoff device, the construction can be continued by the release input by a construction worker. If the flow rate abnormality or the sensor abnormality occurs truly, the release input is not accepted because the construction worker does not exist. Further, even if the release input is received after the given time period from the abnormality determination, the flow rate abnormality and the sensor abnormality are not released. Thus, the safety of the gas shutoff device is secured.

It is configured so that the previously-set time period for accepting the release input of the valve-closing timer section 14 can be changed from outside. Thus, it can be changed to an appropriate time period compatible with a construction time for the shift in the amount of heat or the installation or replacement of the gas shutoff device after the gas shutoff device is produced. Accordingly, if there is occurred a case where the erroneous determination of the flow rate abnormality or the sensor abnormality cannot be released under construction such as the shift in the amount of heat or the installation or replacement of the gas shutoff device, the occurrence of this type of problem can be decreased by elongating the setting value. Further, it becomes unnecessary to set the time period for accepting the release input to be longer more than necessary. Thus, the abnormality determination when the flow rate abnormality or the sensor abnormality is truly occurred can be determined early, thereby improving the safety of the gas shutoff device.

It is configured so that the release input to the valve-closing timer section 14 can be accepted only within the predetermined time for accepting the release input and when the number of times for accepting the release input is less than a predetermined setting number of times. If the flow rate abnormality or the sensor abnormality is truly occurred, the abnormality determination is repeated many times even if the abnormality determination is released. Thus, it becomes possible to determine the abnormality early because the release input is accepted only when the number of times for accepting the release input is less than the predetermined setting number of times, thereby improving the safety of the gas shutoff device.

It is configured so that the number of times for accepting the release input of the valve-closing timer section 14 can be changed from outside. Thus, it can be changed to an appropriate number of times compatible with a construction for the shift in the amount of heat or the installation or replacement of the gas shutoff device after the gas shutoff device is produced. Accordingly, if there is occurred a case where the erroneous determination of the flow rate abnormality or the sensor abnormality cannot be released under construction such as the shift in the amount of heat or the installation or replacement of the gas shutoff device, the occurrence of this type of problem can be decreased by increasing the setting value. Further, it becomes unnecessary to set the number of times for accepting the release input to be increased more than necessary. Thus, the abnormality determination when the flow rate abnormality or the sensor abnormality is truly occurred can be determined early, thereby improving the safety of the gas shutoff device.

It is configured so that the display section 18 displays, as a display signal F, that the release input to the valve-closing timer section 14 is accepted and the valve-opening signal E is output. Upon viewing this indication, the construction workers, etc. can find that the flow rate abnormality or the sensor abnormality occurs, that the release input is accepted and the valve is opened, or how many times the release input is accepted. Accordingly, it becomes possible for the construction workers, etc. to find that the valve-closing occurs due to the erroneous determination, due to the truly flow rate abnormality or the sensor abnormality, or due to the fact other than the flow rate abnormality and the sensor abnormality.

It is configured so that the information indicating that the release input is accepted and the valve-opening signal is output is output outside the gas shutoff device, for example, to a notification apparatus (not shown in figures) of a gas supplier through a communication line such as a telephone line. Upon finding the information, one can find that the flow rate abnormality or the sensor abnormality occurs, that the release input is accepted and the valve is opened, or how many times the release input is accepted. Accordingly, even if the person does not join the construction, it becomes possible to find that the valve-closing occurs due to the erroneous determination, due to the truly flow rate abnormality or the sensor abnormality, or due to the fact other than the flow rate abnormality and the sensor abnormality.

This application is based upon Japanese Patent Application No. 2008-323689 filed on Dec. 19, 2008, the contents of which are incorporated herein by reference.

INDUSTRIAL APPLICABILITY

The gas shutoff device according to the invention as mentioned above is available as a shutoff device for fluid such as water, not only for gas.

The invention claimed is:

1. A gas shutoff device, comprising:

a flow rate detection section which outputs a flow rate signal in response to a gas flow rate passing through a gas passage;

a flow rate calculation section which calculates a flow rate upon receiving the flow rate signal;

an abnormal flow rate determination section which compares the flow rate with a previously-retained determination value upon receiving the flow rate, and outputs a valve-closing signal if abnormality exists in the comparison;

a sensor abnormality determination section which outputs a valve-closing signal if the flow rate signal is in accord with a predetermined abnormal condition;

a valve driving section which outputs a valve-closing drive signal as a valve driving signal upon receiving the valve-closing signal from either the abnormal flow rate determination section or the sensor abnormality determination section, and outputs a valve-opening drive signal as the valve driving signal upon receiving a valve-opening signal;

a valve which opens or closes the gas passage upon receiving the valve driving signal from the valve driving section; and a valve-closing timer section which starts to time upon receiving the valve-closing drive signal from the valve driving section, and outputs the valve-opening signal when an external release input is accepted only within a predetermined setting time.

2. The gas shutoff device according to claim 1, wherein the valve-closing timer section can change, from outside, the predetermined setting time for accepting the release input.

3. The gas shutoff device according to claim 1, wherein the valve-closing timer section accepts the release input only within the predetermined setting time for accepting the release input and when a number of times for accepting the release input is less than a predetermined setting number of times.

4. The gas shutoff device according to claim 3, wherein the valve-closing timer section can change, from outside, the predetermined setting number of times for accepting the release input.

5. The gas shutoff device according to claim 1, wherein the valve-closing timer section outputs a display signal indicating that the release input is accepted and the valve-opening signal is output.

6. The gas shutoff device according to claim 1, wherein the valve-closing timer section externally outputs information indicating that the release input is accepted and the valve-opening signal is output.

7. The gas shutoff device according to claim 1, further comprising:

a recovery input section which outputs a valve-opening signal upon accepting a recovery input from outside, wherein the valve driving section accepts the valve-opening signal from the recovery input section normally, but does not accept the valve-opening signal from the recovery input section during flow rate abnormality or sensor abnormality.

8. A gas shutoff device, comprising:

a flow rate detection section which outputs a flow rate signal in response to a gas flow rate passing through a gas passage;

a flow rate calculation section which calculates a flow rate upon receiving the flow rate signal;

an abnormal flow rate determination section which compares the flow rate with a previously-retained determination value upon receiving the flow rate, and outputs a valve-closing signal if abnormality exists in the comparison;

a sensor abnormality determination section which outputs a valve-closing signal if the flow rate signal is in accord with a predetermined abnormal condition;

a valve driving section which outputs a valve-closing drive signal as a valve driving signal upon receiving the valve-closing signal from either the abnormal flow rate determination section or the sensor abnormality determination section, and outputs a valve-opening drive signal as the valve driving signal upon receiving a valve-opening signal;

a valve which opens or closes the gas passage upon receiving the valve driving signal from the valve driving section; and a valve-closing timer section which starts to time upon receiving the valve-closing drive signal from the valve driving section, and outputs the valve-opening signal when an external release input is accepted within a predetermined setting time and when a number of times for accepting the external release input is less than a predetermined number of times.

9. The gas shutoff device according to claim 8, wherein the valve-closing timer section can modify, externally, the predetermined number of times for accepting the external release input.

* * * * *